United States Patent [19]

Eberhardt

[11] 4,337,830

[45] Jul. 6, 1982

[54] PUMP ASSEMBLY

[75] Inventor: H. Alfred Eberhardt, Paoli, Pa.

[73] Assignee: Hale Fire Pump Company, Conshohocken, Pa.

[21] Appl. No.: 120,139

[22] Filed: Feb. 11, 1980

Related U.S. Application Data

[62] Division of Ser. No. 902,350, May 3, 1978, Pat. No. 4,209,282.

[51] Int. Cl.[3] ..... A62C 27/00

[52] U.S. Cl. ..... 169/24; 169/62; 417/234

[58] Field of Search ..... 169/13, 16, 24, 52, 169/62; 417/251, 234; 415/170 A, 110, 111, 112

[56] References Cited

U.S. PATENT DOCUMENTS

| | | | |
|---|---|---|---|
| 1,737,870 | 12/1929 | Telfer | 415/170 A |
| 2,280,626 | 4/1942 | Carpenter | 417/251 |
| 2,918,975 | 12/1959 | Coveny et al. | 417/234 |

*Primary Examiner*—Robert J. Spar
*Assistant Examiner*—Kenneth Noland
*Attorney, Agent, or Firm*—Harding, Earley & Follmer

[57] ABSTRACT

A pump assembly for use in fire fighting service is constructed of a single stage main pump and a two stage booster pump connected in series with the discharge of the main pump being connected to a first high flow rate fire fighting application and to the inlet of the booster pump and the discharge of the booster pump being connected to a second low flow high pressure fire fighting application. The impellers for both the main pump and the booster pump are mounted on a common rotating shaft so as to be driven thereby. A flow restriction and conduit means is provided to reduce the pressure on the booster pump seal. A by-pass conduit is arranged to conduct flow from the discharge of the booster pump back to the inlet of the main pump so that whenever the main pump is operated there will be flow through the booster pump to prevent overheating thereof.

11 Claims, 3 Drawing Figures

PUMP ASSEMBLY

This is a division of application Ser. No. 902,350 filed May 3, 1978, now U.S. Pat. No. 4,209,282.

BACKGROUND AND SUMMARY OF THE INVENTION

In the field of fire fighting there is a need for a pump assembly for a fire truck which is capable of delivering water at a first pressure to a first high flow rate fire fighting application, such as a 2½ inch discharge fire hose, and to deliver water at a second pressure (substantially higher than said first pressure) to a second low flow high pressure fire fighting application, such as a booster pump reel.

In accordance with the invention there is provided a pump assembly of the indicated type that is inexpensive to construct, easy to operate and reliable. To this end, the pump assembly in accordance with the invention is provided with a main pump and a booster pump connected in series with the discharge of the main pump being delivered to a first high flow rate fire fighting application and to the inlet of the booster pump and the discharge of the booster pump being delivered to a second low flow high pressure fire fighting application. The impellers for both the main pump and the booster pump are mounted on a common rotating shaft so as to be driven thereby. In accordance with another feature of the invention a means are provided to reduce the pressure on the booster pump seal. In accordance with still another feature of the invention a by-pass conduit is arranged to conduct flow from the discharge of the booster pump back to the inlet of the main pump so that whenever the main pump is operated there will be flow through the booster pump to prevent overheating thereof.

The pump assembly of the invention involves simplicity and speed of operation. Both the booster pump and the main pump always operate together permitting the fireman to operate either the first or second fire fighting application or both of them together. Typically, the booster pump is connected to a booster pump line which is wrapped on a "live" reel and connected to a fog nozzle, and is usually placed into service as soon as possible when the fire truck arrives at the site of a fire and is supplied from a tank carried on the fire truck. It takes a high pressure to overcome friction of the booster reel's small diameter hose which uses a relatively small flow of water and can only operate for limited periods of time to dispense the tank water efficiently onto the fire. Maximum cooling effect or water vaporization can be achieved by the small volume booster fire stream if the stream is broken up into very fine particles through a fog nozzle. Also, since the reel's hose is much smaller and lighter than the 2½ inch discharge hoses, it can be handled more easily and placed into service much more quickly. By reason of the construction of the pump assembly in accordance with the invention, the fireman can place in operation the main pump that supplies the 2½ inch discharge hoses easily and without delay. This is achieved by simply opening the discharge valve to which the 2½ inch discharge fire hose has been connected and without making any changes in the operation of the pump assembly or opening and closing a number of valves. Thus, the first and second fire fighting applications are performed concurrently and speedily. There is no need to slow down the drive to permit disengagement of the booster pump and engagement of the main pump as is the case with most types of fire fighting equipment in use today in which the booster pump and the main pump are driven by independent means. Thus, the prior art equipment involves a substantial time delay as compared with the pump assembly in accordance with the invention.

Another type of prior art pump assembly that has been used is designed to achieve the high pressure necessary to operate a booster reel by providing two impellers and means for operating the impellers in either series or parallel, the higher pressure operation being achieved by arranging the impellers in series. The discharge passage of this type of pump has available either high pressure low volume water in series or low pressure high volume water in parallel, but not both. Thus, such a pump cannot operate at two pressure levels unless an intermediate discharge from the first stage is provided, but this requires separate and expensive piping.

In accordance with another prior art pump assembly a third impeller is clutched onto the impeller shaft of a two stage pump and is connected to a low flow and high pressure application. However, this arrangement is unsatisfactory because it involves a high pressure seal at the third stage inlet, which high pressure seal is subject to excessive wear and premature failure. Additionally, the clutch is a source of mechanical problems, added expense and the pump has to be slowed down to engage and disengage the clutch.

Another feature of the pump assembly of the invention is that it is hydraulically engineered to provide the optimum hydraulic design for the impellers of both the main pump and the booster pump. This is not possible with the prior art pumps discussed above. In the typical series-parallel pump, the impellers are designed for much higher flow rates than would be handled by a booster line. For example, a series-parallel pump designed to operate at a flow rate of 1000 G.P.M. in the series arrangement, is designed so that each impeller handles 500 G.P.M. However, an impeller designed to handle 500 G.P.M. is not at all efficient when handling 30–50 G.P.M., which is the flow rate for a typical booster line application. In the pump assembly of the invention there is used a two stage booster pump having a small impeller diameter specifically designed for booster line applications. Such an impeller has a substantially lower power requirement as compared with the large diameter impellers of the prior art. Also, by reason of the small impeller diameter of the booster pump, there is very little drag (friction loss) on the main pump when the booster pump is not in use.

An additional feature of the pump assembly in accordance with this invention is that it can be retrofitted to existing fire trucks easily and can utilize previously available pump designs for both the booster pump and the main pump with minor modifications.

DESCRIPTION OF THE PREFERRED EMBODIMENT

Figure 1:
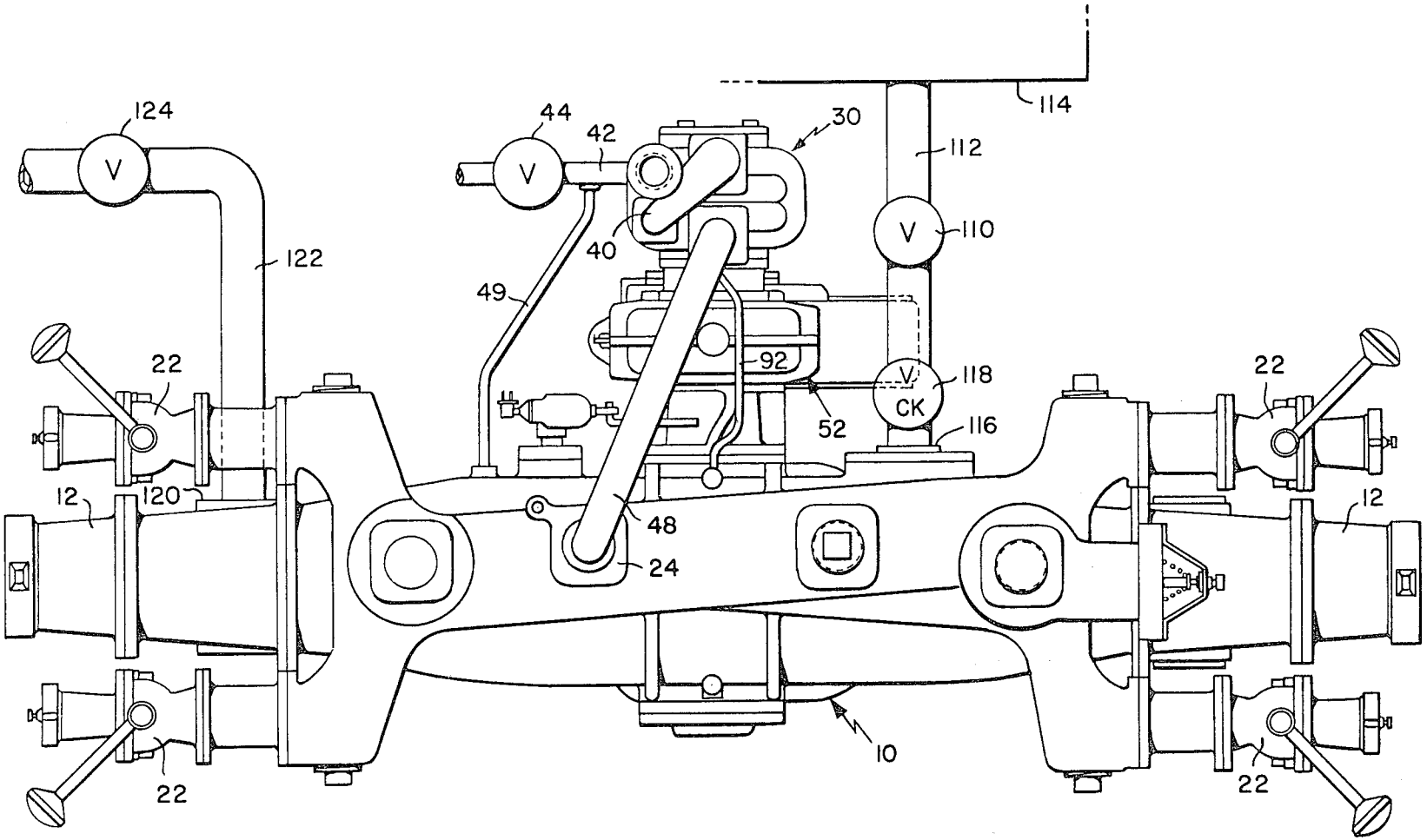
FIG. 1 is a top plan view of the pump assembly in accordance with the invention.

The pump assembly in accordance with the invention comprises a main pump 10 of the centrifugal type having an inlet provided by a pair of inlet tubes 12 constructed and arranged to be connected to a water supply from either side of a fire truck and communicating with inlet chambers 14 at the entrance to the single stage double suction impeller 16. The exit 18 from the impeller 16 communicates with a main pump discharge passsage 20 which communicates with discharge valves 22 adapted to be connected to a first, high flow rate, fire fighting application, typically a 2½ inch discharge fire hose.

The pump assembly also comprises a booster pump 30 of the centrifugal type having an inlet provided by an inlet passage 32 communicating at its downstream end with an inlet chamber 34 at the entrance to the first stage impeller 36 of a two stage impeller means for the booster pump 30. The exit from the first stage impeller 36 is connected to the entrance of a second stage impeller 38 by means of a U-shaped cross-over tube 40. The exit from second stage impeller 38 is in communication with a discharge tube 42 connected to a discharge valve 44 adapted to be connected to a second, low flow high pressure, fire fighting application, typically, a booster hose line coiled on a "live" booster reel.

Means are provided for connecting the discharge from main pump 10 to the suction of booster pump 30. To this end, a pipe conduit 48 is connected between a fitting 24, which communicates with discharge passage 20, and inlet passage 32. Pipe conduit 48 delivers water from the discharge of main pump 10 to the inlet of booster pump 30.

Means are provided for communicating flow from the discharge of booster pump 30 back to the inlet of main pump 10. To this end, a by-pass conduit 49 is connected from discharge tube 42 back to the main pump suction at inlet chamber 14. By-pass conduit 49 is always open to flow so that circulation of flow is maintained through booster pump 30 anytime main pump 10 is operated whether valve member 44 is open or closed. This flow prevents overheating of booster pump 30.

Figure 2:
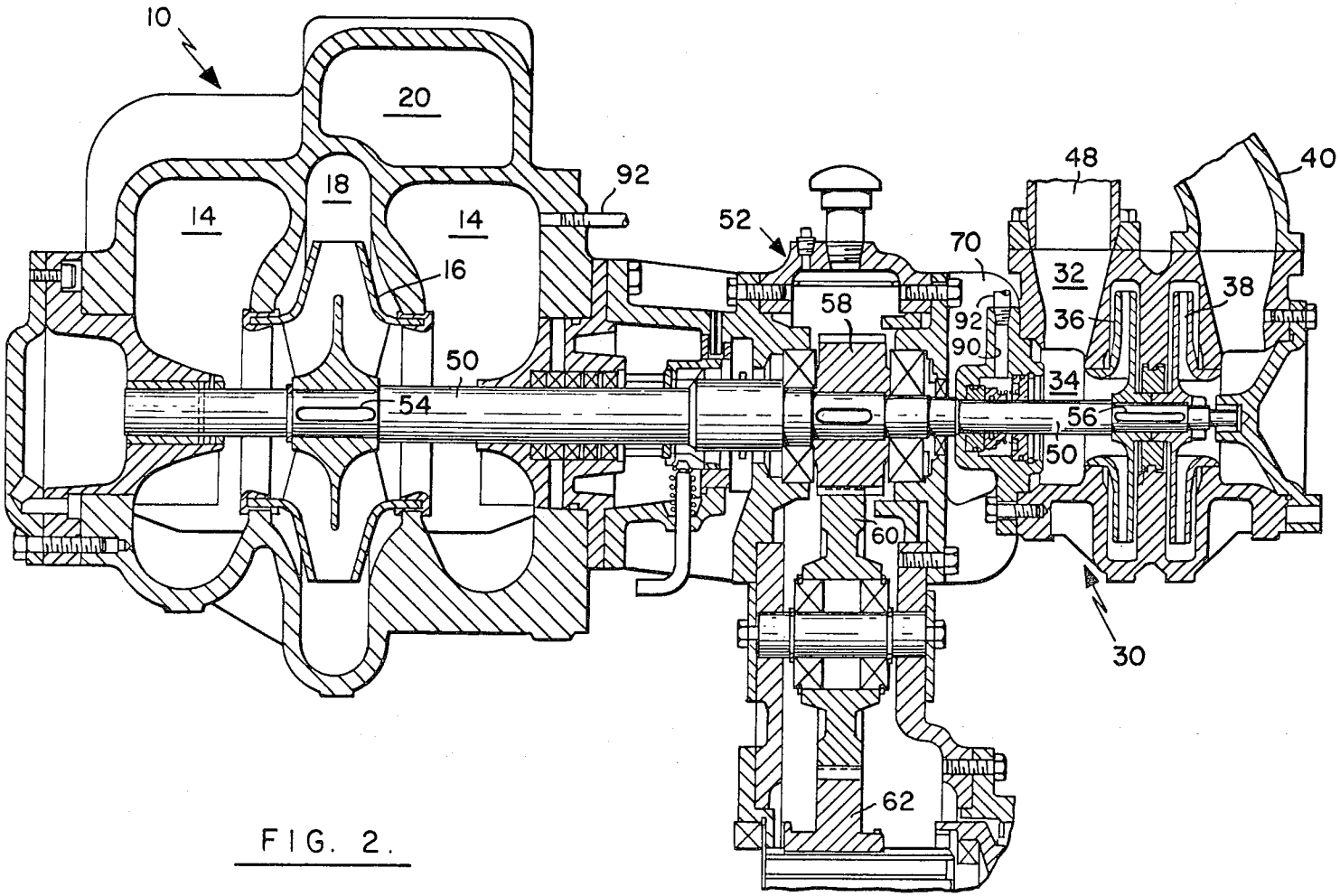
FIG. 2 is a sectional view in elevation of the pump assembly in accordance with the invention.
Figure 3:
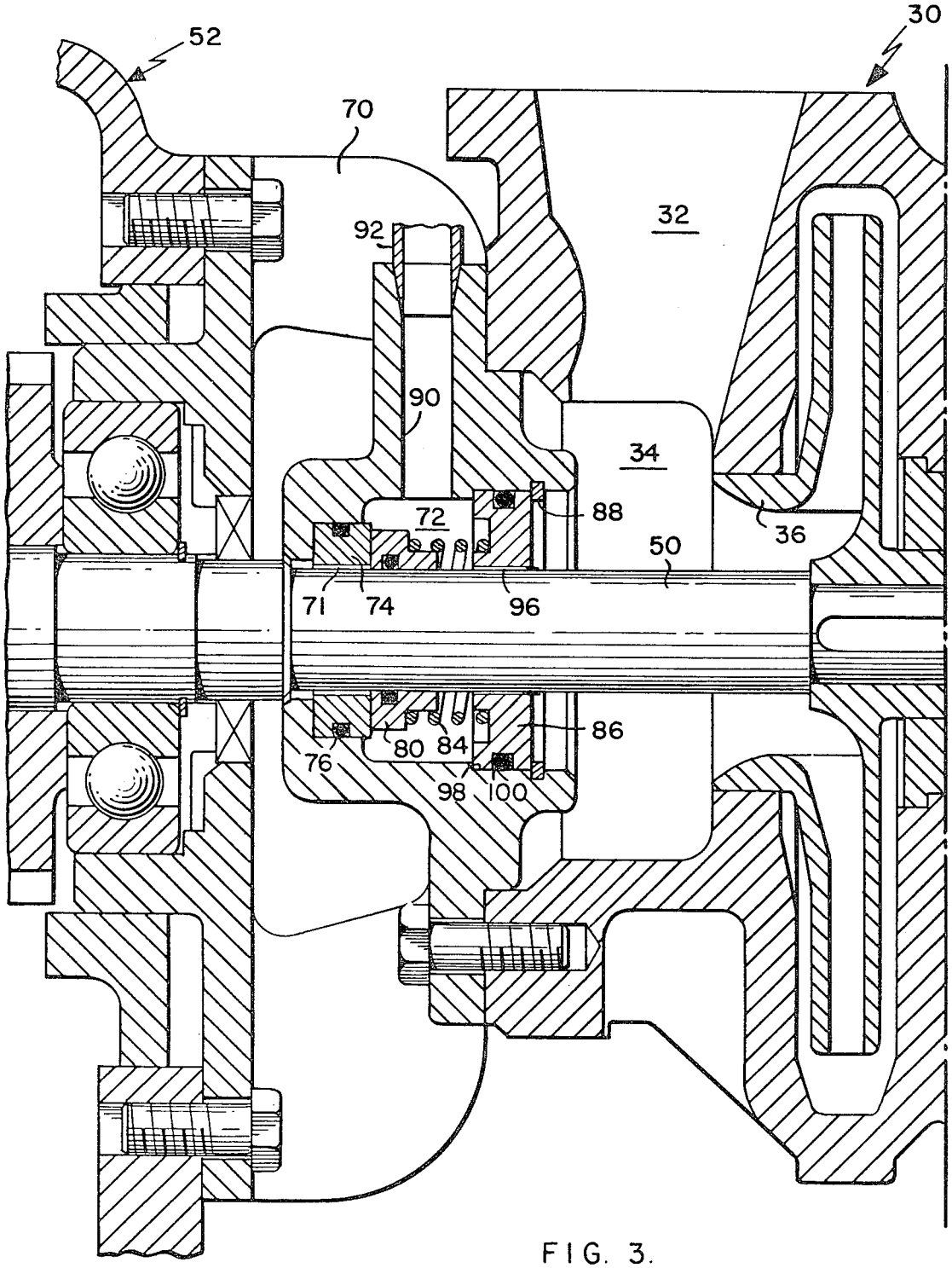
FIG. 3 is a detail view showing the seal at the inlet of the booster pump impeller means.

In accordance with the invention, there is provided impeller drive means for main pump 10 and booster pump 30 comprising a common rotating pump shaft 50. Shaft 50 is rotatably supported by bearings in a drive unit housing 52 and extends in both directions therefrom. Referring to FIG. 2, the portion of shaft 50 extending to the left of housing 52 has impeller 16 drivingly mounted thereon by means of a key 54 and the portion of shaft 50 extending to the right from housing 52 has impellers 36 and 38 of booster pump 30 drivingly mounted thereon by means of a key 56.

The portion of shaft 50 within housing 52 has a gear 58 keyed thereon for causing rotation of shaft 50. Gear 58 is driven by means of an intermediate gear 60 which is, in turn, driven by a sliding gear 62. Sliding gear 62 is constructed and arranged to be driven from the transmission of the fire truck and is conventional and well known in the art.

In accordance with a feature of the invention, a seal means is provided to reduce the pressure at the seal at inlet to booster pump 30 to a pressure approximating that of the main pump suction. To this end, an adapter 70, which forms part of the housing of booster pump 30 and mounts booster pump 30 onto drive unit housing 52, defines a chamber 72 surrounding pump shaft 50 at a location adjacent inlet chamber 34. A mechanical seal means is provided between shaft 50 and adapter 70 to prevent the flow of water from chamber 72 to the exterior of booster pump 30.

Such seal means comprises an annular wear resistant seal seat member 74 mounted in a recess in the adapter 70 with shaft 50 extending through the inner opening 71 therein. The outer rim of seat member 74 receives an O-ring seal 76 constructed and arranged to provide a seal between seat member 74 and adapter 70 and to hold seat member 74 frictionally in a stationary position in adapter 70. The mechanical seal means comprises a sealing element 80 mounted for rotation with shaft 50 to cooperate with seat member 74 to seal the portion of shaft 50 extending from chamber 72 to the exterior of adapter 70 as is well known in the art. Means are provided biasing sealing element 80 into sealing contact with seat member 74, such means comprising a spring 84, a spring holder 86 and a snap-ring retainer 88 for spring holder 86, such parts being constructed and arranged so that spring 84 is in compression between spring holder 86 and sealing element 80 to thereby urge the same toward seat member 74. Such seal means are well known in the art.

Conduit means are provided for connecting chamber 72 to the suction of main pump 10. Such conduit means comprises a drilled hole 90 in adapter 70 communicating with chamber 72 and a pipe conduit 92 connected between hole 90 and chamber 14 of main pump 10. By reason of this flow connection the pressure in chamber 72 is maintained to be approximately the same as the pressure at the suction of main pump 10.

Means are provided for controlling a leakage flow from inlet chamber 34 to chamber 72 so that the high pressure in inlet chamber 34 is dissipated down to the low pressure in chamber 72, i.e., approximately the main pump suction pressure. Such means comprises spring holder 86 which has its internal wall 96 cooperating with pump shaft 50 with a close fit to allow minimal leakage flow therebetween. Spring holder 86 is received in a recess 98 in adapter 70 and held against axial movement by retainer snap-ring 99. An O-ring seal 100 provides a seal between the outer rim of spring holder 86 and adapter 70 and serves to frictionally hold spring holder 86 in a non-rotating position.

Since the pressure applied to chamber 72 is reduced to a very low pressure, namely, approximately the pressure at the suction of main pump 10, by reason of the above-described construction and arrangement of parts, the mechanical seal for chamber 72 is subjected to less wear and will have a longer life than would be the case if the seal had to withstand the high pressure in inlet chamber 34 of booster pump 30.

A typical fire fighting application in which the pump assembly is used will now be described with reference to FIG. 1. When the first fire truck arrives at the scene of the fire a tank valve 110 in a tank line 112 is probably already open. Tank line 112 is connected between a booster tank 114 (which contains a supply of water) and main pump inlet 116. After setting the truck's parking brakes, the main pump 10 is engaged. The booster line's discharge valve 44 is opened and the fireman pulls the required amount of booster hose off the "live" reel, the engine is speeded up and the fireman applies the low volume, high pressure stream (straight or fog) to the fire.

Meanwhile, a main pump inlet 120 is being connected via a 2½ inch or larger hose 122 to the nearest source of water—usually a hydrant—or a second pumper stationed at a hydrant (or pond). The changover from using the fire truck's booster tank 114 to the external line supplying the inlet 120 to the main pump 10 is usually done instantaneously and automatically when the main pump's inlet valve 124 is opened and the higher inlet pressure closes the booster tank's check valve 118 connected in tank line 112.

Usually simultaneously, a 2½ inch discharge line is connected and laid between the main pump 10 of the first fire truck and the fire. After completing these connections and hose lays, a 2½ inch discharge valve 22 of the main pump 10 is opened and a high volume stream, using the lower main pump discharge pressure, is applied to the fire without requiring any interruption in the operation of the booster line.

The pump assembly in accordance with the invention can be operated to deliver water from a suitable supply through either or both of the discharge valves 22 and 44. In a typical operation of the pump assembly, pump shaft 50 is driven from the transmission of the fire truck to cause main pump 10 to draw water at a hydrant residual pressure, say 20 p.s.i., and to discharge water to discharge passage 20 at a pressure of about 175 p.s.i. When a discharge valve 22 is open and discharge valve 44 is closed, the water is delivered at about 175 p.s.i. to a first high flow rate fire fighting application (i.e. a discharge fire hose) and water is circulated through booster pump 30 to discharge tube 42 and by-passed back to the main pump suction at chamber 14 by way of conduit 49. This circulating flow through booster pump 30 prevents overheating of booster pump 30. When the discharge valve 22 is closed and discharge valve 44 is open, water is delivered to the inlet of booster pump 30 through pipe conduit 48 and is discharged from booster pump 30 through discharge tube 42 and discharge valve 44 at a pressure of about 400 p.s.i. to a second low flow high pressure fire fighting application (i.e. a booster reel). When both discharge valve 22 and discharge valve 44 are open, water is delivered to the discharge fire hose and the booster reel at pressures of 175 p.s.i. and 400 p.s.i., respectively.

In accordance with the mode of operation described above, the volute and the impellers 36 and 38 of booster pump 30 are hydraulically designed to pump water optimumly at low volume and high pressure. Also, impellers 36 and 38 are substantially smaller in diameter than the impeller 16 of main pump 10. This is shown clearly in FIG. 2.

It will be noted that during operation of the pump assembly as described above, conduit 92 serves to apply the pressure of approximately 20 p.s.i. in the suction chamber 14 to the seal chamber 72 adjacent the inlet to the booster pump 30.

I claim:

1. A pump assembly for use in fire fighting service and adapted to be mounted on a mobile unit such as a fire truck comprising:

a main pump having an impeller means, a suction to the impeller means, and a discharge from the impeller means, means for connecting the discharge of said main pump to a first high flow rate fire fighting application, a booster pump having an impeller means, an inlet to the booster pump impeller means, and a discharge from the booster pump impeller means, means for connecting the discharge of said booster pump to a second fire fighting application, means for connecting the discharge from said main pump to the inlet of said booster pump, and drive means for said main pump and said booster pump including rotating pump shaft means, said main pump impeller means being mounted on one portion of said shaft means so as to be driven thereby, and said booster pump impeller means being mounted on another portion of said shaft means so as to be driven thereby, valve means for controlling the flow through said main pump and booster pump discharges and operable to flow control positions in which flow is permitted through either of said discharges only or through both of said discharges concurrently, said booster pump discharge being connected to a low flow high pressure second fire fighting application such as a hose reel and said first fire fighting application comprises a fire hose, valve means controlling the flow from said booster pump discharge to said second fire fighting service and a by-pass conduit providing flow from a part of said booster pump inlet upstream of said valve means back to the inlet of said main pump.

2. A pump assembly according to claim 1 wherein said by-pass conduit is always open to flow whereby flow is maintained through said booster pump any time said main pump is operated whether said valve means is open or closed.

3. A pump assembly according to claim 2 comprising valve means controlling the flow from said main pump discharge to said first fire fighting service, said by-pass conduit being connected to said main pump discharge upstream of said valve means controlling flow from said main pump.

4. A pump assembly according to claim 3 wherein said main pump is a single stage pump constructed to deliver water to said first fire fighting application and to said booster pump at a first pressure and said booster pump is a two stage pump constructed to deliver water to said second fire fighting application at a second pressure substantially higher than said first pressure.

5. A pump assembly for use in fire fighting service and adapted to be mounted on a mobile unit such as a fire truck comprising:

a main pump having an impeller means, a suction to the impeller means, and a discharge from the impeller means, means for connecting the discharge of said main pump to a first high flow rate fire fighting application, a booster pump having an impeller means, an inlet to the booster pump impeller means, and a discharge from the booster pump impeller means, means for connecting the discharge of said booster pump to a second fire fighting application, means for connecting the discharge from said main pump to the inlet of said booster pump, and drive means for said main pump and said booster pump including rotating pump shaft means, said main pump impeller means being mounted on one portion of said shaft means so as to be driven thereby, and said booster pump impeller means being mounted on another portion of said shaft

United States Patent [19]

Thaxton

[11] 4,337,831

[45] Jul. 6, 1982

[54] FIRE EXTINGUISHING APPARATUS FOR OIL WELLS

[76] Inventor: Darrel G. Thaxton, P.O. Box 201, Athens, La. 71003

[21] Appl. No.: 128,065

[22] Filed: Mar. 7, 1980

[51] Int. Cl.[3] ..... A62C 35/12

[52] U.S. Cl. ..... 169/69; 169/14; 166/364; 251/322

[58] Field of Search ..... 169/69, 46, 47, 18, 169/16, 74, 89, 5, 9, 14, 76; 166/364, 363, 90; 220/366, 367, 373; 251/322

[56] References Cited

U.S. PATENT DOCUMENTS

| | | | |
|---|---|---|---|
| 1,674,427 | 6/1928 | Freygang | 169/89 |
| 2,860,856 | 11/1958 | Bauer | 169/14 |
| 2,988,151 | 6/1961 | Dion-Biro | 169/14 |
| 3,092,183 | 6/1963 | Guise et al. | 169/74 |
| 3,589,446 | 6/1971 | Bower | 169/89 |
| 4,069,873 | 1/1978 | McClure | 169/16 |

FOREIGN PATENT DOCUMENTS

| | | | |
|---|---|---|---|
| 46203 | 1/1911 | Fed. Rep. of Germany | 169/69 |

*Primary Examiner*—Robert J. Spar
*Assistant Examiner*—Kenneth Noland
*Attorney, Agent, or Firm*—Sughrue, Mion, Zinn, Macpeak & Seas

[57] ABSTRACT

A fire extinguishing apparatus for oil wells has a plurality of containers for containing fire extinguishing material connected to a main fire extinguishing container. The main fire extinguishing container has a conduit leading from a valve in the neck thereof to the interior of a bell nipple positioned on an oil well blow out preventor. A bracket attached to the main container supports a manually operable spring loaded mechanism which is adapted, upon release of the spring loaded plunger contained therein, to open a valve in the neck of the main container and allow the content of the several containers to flow under pressure through conduits into the interior of the bell nipple thus extinguishing a fire therein. An additional valved line is attached to the bell nipple at one end thereof with the opposite end connected to a source of fire extinguishing materials located at a remote area onshore so that if the manually operable spring loaded mechanism cannot be operated on the oil well platform, then the source of fire extinguishing material at the remote location may be operated so as to cause fire extinguishing materials to flow through the additional valved conduit into the interior of the bell nipple extinguishing a fire therein.

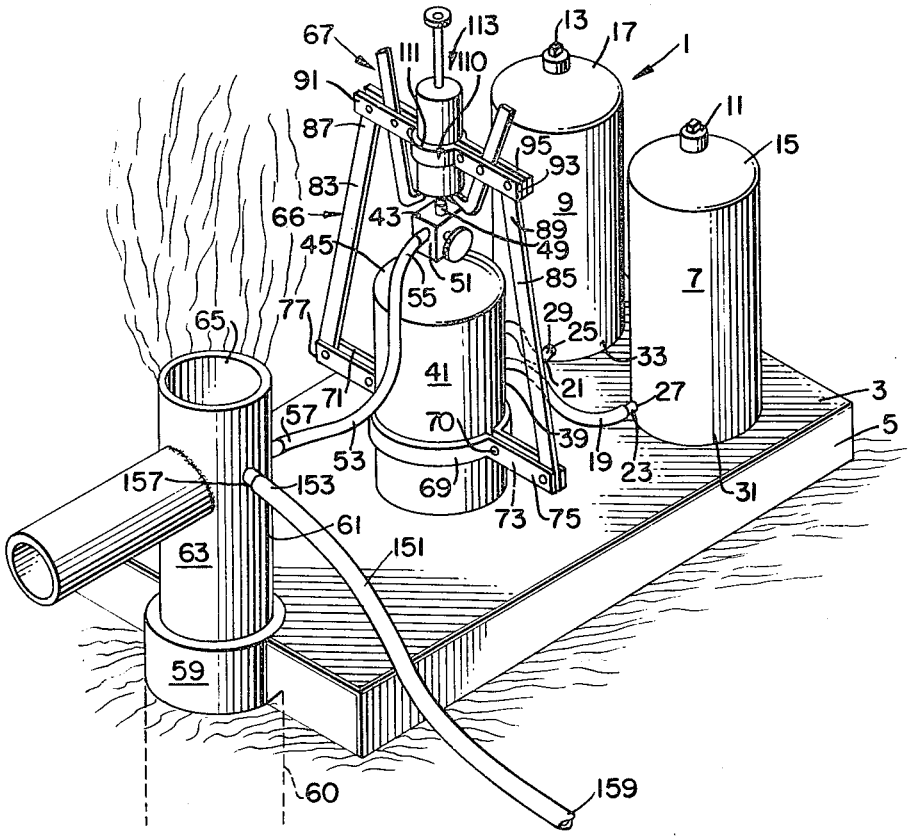

9 Claims, 4 Drawing Figures